US005799460A

United States Patent [19]

Jensen

[11] Patent Number: 5,799,460

[45] Date of Patent: Sep. 1, 1998

[54] METHOD OF SHINGLING A ROOF AND INTERLOCKING ROOFING SYSTEM

[75] Inventor: Dan Velling Jensen, St. Albert, Canada

[73] Assignee: Brian Dary, Onoway, Canada

[21] Appl. No.: 810,341

[22] Filed: Feb. 27, 1997

[51] Int. Cl.[6] ..... E04D 1/18

[52] U.S. Cl. ..... 52/530; 52/520; 52/529; 52/545; 52/460; 52/468; 52/748.1

[58] Field of Search ..... 52/518, 519, 520, 52/521, 529, 530, 531, 535, 539, 545, 556, 459, 460, 465, 468, 470, 471, 472, 747.1, 748.1

[56] References Cited

U.S. PATENT DOCUMENTS

| | | | |
|---|---|---|---|
| 34,954 | 1/1862 | Hayden . | |
| 462,375 | 11/1891 | Couch et al. . | |
| 673,613 | 5/1901 | Bennett | 52/531 |
| 968,061 | 8/1910 | Kramer . | |
| 1,091,049 | 3/1914 | Edwards . | |
| 1,204,885 | 11/1916 | Koerner . | |
| 1,533,923 | 4/1925 | Knoll . | |
| 1,743,206 | 1/1930 | Fulenwider . | |
| 2,434,185 | 1/1948 | Whitehouse | 52/529 X |
| 2,495,303 | 1/1950 | Wisniewski | 52/468 |
| 2,520,499 | 8/1950 | Golaz | 52/460 |
| 2,601,833 | 7/1952 | Olsen . | |
| 3,089,282 | 5/1963 | Tennison | 52/529 X |
| 3,108,405 | 10/1963 | Charles | 52/531 |
| 3,367,079 | 2/1968 | Berg | 52/530 X |
| 3,381,426 | 5/1968 | Heidrich . | |
| 3,667,184 | 6/1972 | Merrill et al. | 52/530 |
| 3,922,824 | 12/1975 | Izawa et al. . | |
| 4,079,561 | 3/1978 | Vallee . | |
| 4,120,132 | 10/1978 | Kendrick . | |
| 4,139,974 | 2/1979 | Fox | 52/468 X |
| 4,218,857 | 8/1980 | Vallée | 52/530 X |
| 4,307,553 | 12/1981 | Puckett . | |
| 4,366,656 | 1/1983 | Simpson . | |
| 4,601,135 | 7/1986 | Ellis et al. . | |
| 4,741,142 | 5/1988 | Otto et al. . | |
| 4,777,776 | 10/1988 | Morrell | 52/531 |
| 4,926,608 | 5/1990 | Beauregard . | |
| 5,065,553 | 11/1991 | Magid . | |

*Primary Examiner*—Carl D. Friedman
*Assistant Examiner*—Kevin D. Wilkens
*Attorney, Agent, or Firm*—Anthony R. Lambert

[57] ABSTRACT

An interlocking roofing system includes, in combination, a plurality of shingles and a plurality of interlock strips. Each of the plurality of shingles includes a planar rectangular body having a first face, a second face, and four sides. Horizontal rows of shingles are interlocked by interlocking a single zigzag reentrant edge on a third side adjacent the second face of one horizontal row of shingles with a double zigzag reentrant edge on a first side adjacent the first face of another horizontal row of shingles. Each of the plurality of interlock strips includes an elongate planar rectangular body having a first face, a second face, and four sides. Shingles are laid in parallel spaced relation with the fourth side of a first shingle adjacent the second side of a second shingle. The shingles are then interlocked by sliding a single zigzag reentrant edge on a second side of the interlock strip under a single zigzag reentrant edge on a fourth side of a second shingle and a single zigzag reentrant edge on a fourth side of the interlock strip under a single zigzag reentrant edge on a second side of the first shingle. The interlock strip is slid along until a single zigzag reentrant edge on a first side of the interlock strip engages a third side of the shingle.

7 Claims, 9 Drawing Sheets

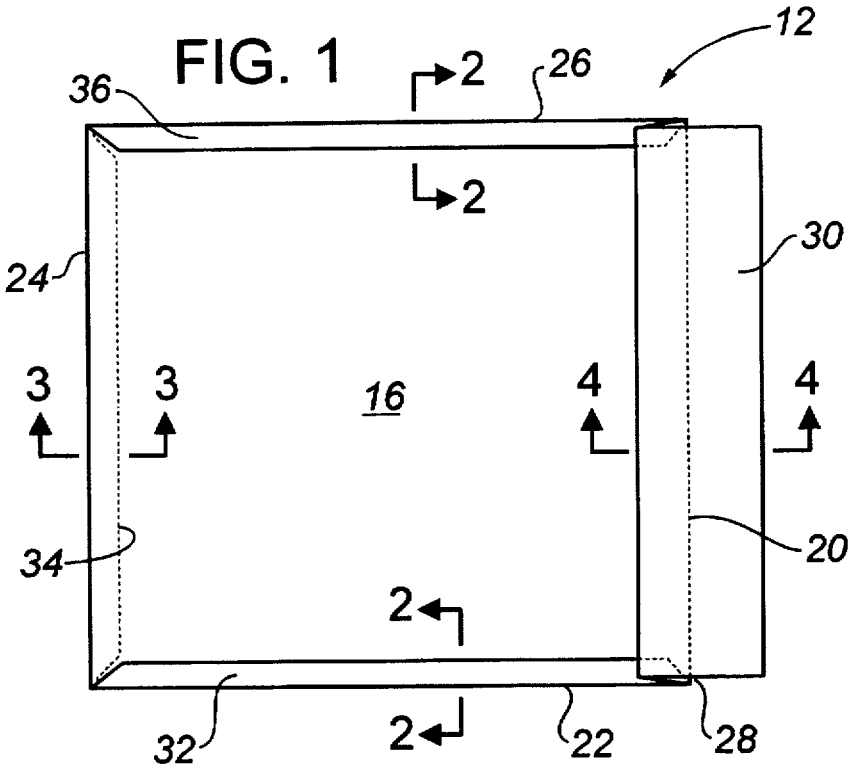
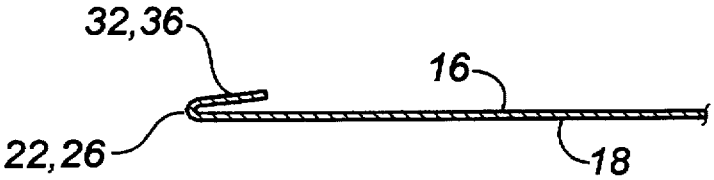
FIG. 2
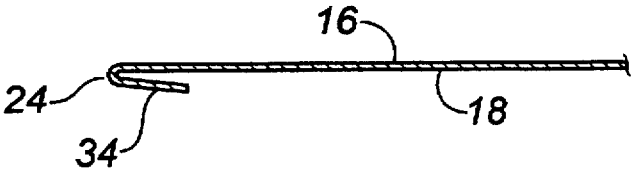
FIG. 3
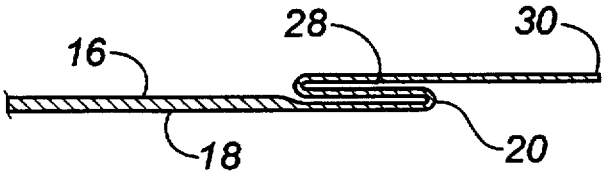
FIG. 4

FIG. 5
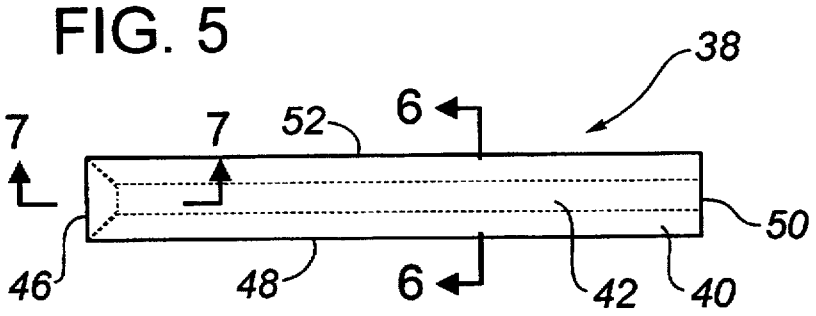
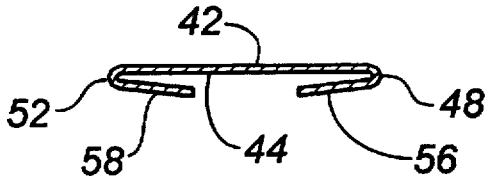
FIG. 6
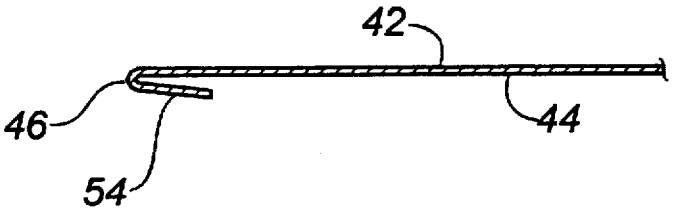
FIG. 7

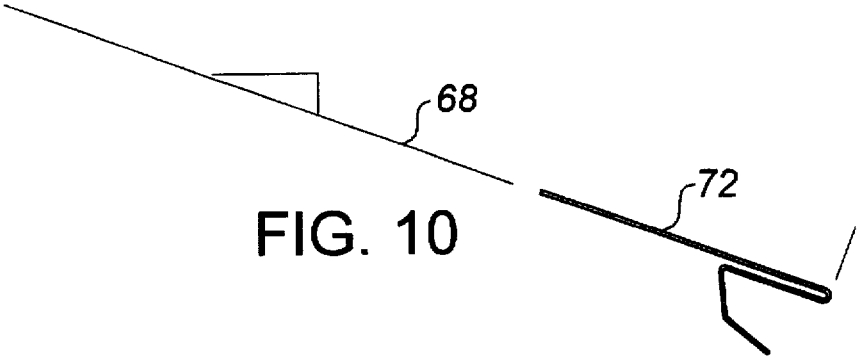
FIG. 10
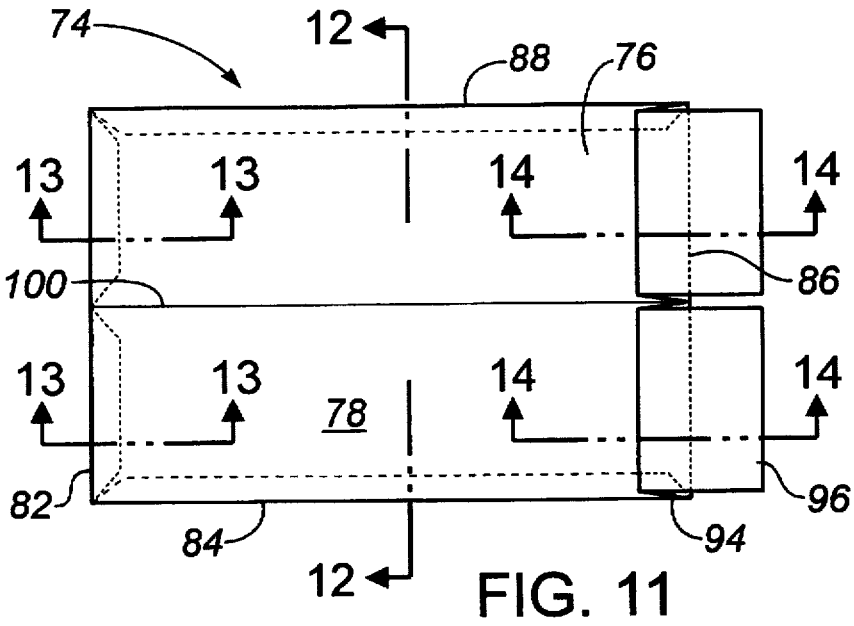
FIG. 11
FIG. 12
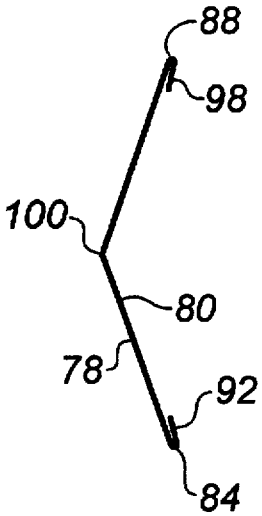
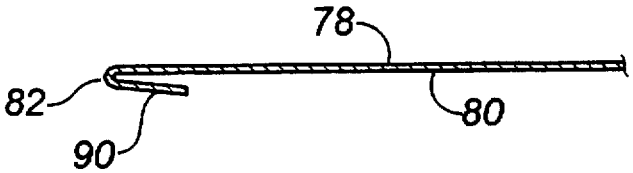
FIG. 13
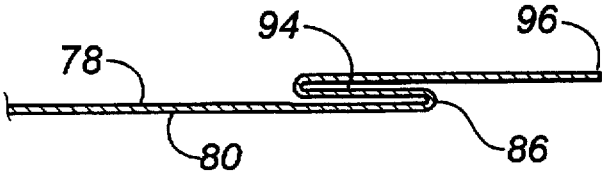
FIG. 14

METHOD OF SHINGLING A ROOF AND INTERLOCKING ROOFING SYSTEM

FIELD OF THE INVENTION

The present invention relates to an interlocking roofing system and, a method of shingling a roof using such a system.

BACKGROUND OF THE INVENTION

Interlocking roofing systems have been known since at least as early as 1862 when John J. Hayden patented an invention entitled "Improvement in Metallic Roofing", U.S. Pat. No. 34,254. The Hayden patent disclosed a system that used a number of small interlocking shingles of differing shapes. U.S. Pat. No. 1,091,049 issued in 1914 to E. W. Edwards for an improved manner of interlock "as to prevent ingress of water at any point along the joint". In contrast to the Hayden reference, the Edwards patent disclosed the use of large sheets. U.S. Pat. No. 1,206,885 which issued to Koerner in 1916 and U.S. Pat. No. 1,533,923 which issued to Knoll in 1925 both disclose interlocking roofing systems that use a plurality of smaller identically shaped shingles.

Modern day interlocking roofing systems resemble to a large extent the roofing systems taught by the Koerner and Knull patents. Smaller shingles are used as they can accommodate vents, fireplaces and skylights with less cutting and waste of materials. Most modern systems endeavour to reduce or eliminate the number of exposed fasteners; as exposed fasteners deteriorate over time. Most modern systems endeavour to maintain seals between adjoining shingles that will remain weathertight over time.

A problem that remains with modern systems is in accommodating irregularities in a roof, while still maintaining a water tight seal. The trusses and sheeting materials used in house construction are imperfect. Every roof has to a greater or lesser extent, depressions and ridges. Roofing systems such as taught by Knoll, are forgiving systems that can accommodate depressions or ridges on a roof. However, the system of Knoll has exposed edges. In a driving rain storm water can get under the shingles at the exposed edges. Even under light rain conditions, capillary action tends to draw water under the shingles. In contrast, the roofing system as taught by Koerner as water tight joints. The system works best on a flat surface where there are no irregularities that prevent the shingles from being locked tight together. When a depression is encountered, there is insufficient space to get a tight interlocking of the shingles. As long as the space discrepancy is not too large, the shingles can be trimmed and an interlock obtained. However, if the discrepancy is too large, the discrepancy cannot be accommodated by trimming as it would result in the interlocking portions of the shingle being cut away. When a ridge is encountered it creates a gap between the shingles. Any kind of gap prevents the interlocking of a system intended to have a tight interlock. When gaps are encountered, they must be filled with caulking. This turns a low maintenance metal roof into a high maintenance installation, as the caulking must be periodically replaced.

SUMMARY OF THE INVENTION

What is required is an interlocking roofing system that is more forgiving in the face of irregularities on the roof.

According to one aspect of the present invention there is provided an interlocking roofing system which includes in combination a plurality of shingles and a plurality of interlock strips. Each of the plurality of shingles includes a planar rectangular body having a first face, a second face, a first side, a second side adjacent the first side, a third side adjacent the second side and a fourth side adjacent the third and first sides. The first side terminates in a double zigzig reentrant edge having an end which projects outwardly from the body adjacent and substantially parallel to the first face. The second side terminates in a single zigzig reentrant edge which projects inwardly adjacent and substantially parallel to the first face. The third side terminates in a single zigzig reentrant edge which projects inwardly adjacent and substantially parallel to the second face. The fourth side terminates in a single zigzig reentrant edge which projects inwardly adjacent and substantially parallel to the first face. Horizontal rows of shingles are interlocked by interlocking the single zigzig reentrant edge on the third side adjacent the second face of one horizontal row of shingles with the double zigzig reentrant edge on the first side adjacent the first face of another horizontal row of shingles. Each of the plurality of interlock strips includes an elongate planar rectangular body having a first face, a second face, a first side, a second side adjacent the first side, a third side adjacent the second side and a fourth side adjacent the third and first sides. The first side terminates in a single zigzig reentrant edge which projects inwardly adjacent and substantially parallel to the second face. The second side terminates in a single zigzig reentrant edge which projects inwardly adjacent and substantially parallel to the second face. The third side terminates in an open edge. The fourth side terminates in a single zigzig reentrant edge which projects inwardly adjacent and substantially parallel to the second face. Shingles in parallel spaced relation with the fourth side of a first shingle adjacent the second side of a second shingle are interlocked by sliding the single zigzig reentrant edge on the second side of the interlock strip under the single zigzig reentrant edge on fourth side of the second shingle and the single zigzig reentrant edge on the fourth side of the interlock strip under the single zigzig reentrant edge on the second side of the first shingle. The interlock strip is slid along until the single zigzig reentrant edge on the first side of the interlock strip engages the third side of the shingle.

A roof can rapidly be completed using the interlocking roofing system described. The interlock strip can accommodate gaps of up to ½ of an inch. Although beneficial results may be obtained through the use of this roofing system, as described above, the roof may be completed even more rapidly when some additional components are added to the basic system. Even more beneficial results may, therefore, be obtained when a plurality of ridge cap interlock strips are used. Each ridge cap interlock strip includes an elongate planar rectangular body having a first face, a second face, a first side, a second side adjacent the first side, a third side adjacent the second side and a fourth side adjacent the third and first sides. The first side terminates in a single zigzig reentrant edge which projects inwardly adjacent and substantially parallel to the second face. The second side terminates in a single zigzig reentrant edge which projects inwardly adjacent and substantially parallel to the second face. The third side terminates in a double zigzig reentrant edge having an end which projects outwardly from the body adjacent and substantially parallel to the first face. The fourth side terminates in a single zigzig reentrant edge which projects inwardly adjacent and substantially parallel to the second face. A bend line extends along the elongate body from the first side to the third side substantially equidistant between the second face and the fourth side.

Even more beneficial results may, therefore, be obtained when a plurality of roof edge interlock strips are used. Each roof edge interlock strip includes an elongate body which is "L" shaped in cross-section. The elongate body has a first face, a second face, a first side, a second side adjacent the first side, a third side adjacent the second side and a fourth side adjacent the third and first sides. The first side terminates in a single zigzig reentrant edge which projects inwardly adjacent and substantially parallel to the second face. The second side terminates in a single zigzig reentrant edge which projects inwardly adjacent and substantially parallel to the second face. The third side terminates in a double zigzig reentrant edge having an end which projects outwardly from the body adjacent and substantially parallel to the first face. The fourth side terminates in a single zigzig reentrant edge which projects inwardly adjacent and substantially parallel to the second face. A bend line extending along the elongate bodys from the first side to the third side substantially equidistant between the second face and the fourth side.

According to another aspect of the present invention, there is provided A method of shingling a roof. Firstly, providing a plurality of shingles, as previously described. Secondly, providing a plurality of interlock strips, as previously described. Thirdly, securing a plurality of the shingles in rows along a roof by placing the shingles in parallel spaced relation along the roof with the second side of one of the plurality of shingles placed adjacent to the fourth side of an adjacent one of the plurality of shingles. The shingles are secured by driving fasteners through the end of the double zigzig reentrant edge which projects outwardly from the body. The shingles in each of the rows are laterally staggered in relation to a next adjacent row. The rows of shingles are interlocked by connecting the single zigzig reentrant edge on the third side adjacent the second face of one row of shingles with the double zigzig reentrant edge on the first side adjacent the first face of the next adjacent row of shingles. Fourthly, interlocking adjacent shingles with one of the plurality of interlock strips by sliding the single zigzig reentrant edge on the second side of the interlock strip under the single zigzig reentrant edge on fourth side of the second shingle and the single zigzig reentrant edge on the fourth side of the interlock strip under the single zigzig reentrant edge on the second side of the first shingle. Each of the interlock strips is slid along until the single zigzig reentrant edge on the first side of the interlock strip engages the third side of the shingle.

BRIEF DESCRIPTION OF THE DRAWINGS

These and other features of the invention will become more apparent from the following description in which reference is made to the appended drawings, wherein:

FIG. 1 is a top plan view of a roof shingle constructed in accordance with the teachings of the present invention.

FIG. 2 is an end elevation view, in section, of the roof shingle illustrated in FIG. 1, taken along section lines A—A.

FIG. 3 is a side elevation view, in section, of the roof shingle illustrated in FIG. 1, taken along section lines B—B.

FIG. 4 is a side elevation view, in section, of the roof shingle illustrated in FIG. 1, taken along section lines C—C.

FIG. 5 is a top plan view of an interlock strip constructed in accordance with the teachings of the present invention.

FIG. 6 is an end elevation view, in section, of the interlock strip illustrated in FIG. 5, taken along section lines A—A.

FIG. 7 is a side elevation view, in section, of the roof shingle illustrated in FIG. 5, taken along section lines B—B.

FIG. 10 is a side elevation view of a roof eave starter strip constructed in accordance with the teachings of the present invention.

FIG. 11 is a top plan view of a ridge cap interlock strip constructed in accordance with the teachings of the present invention.

FIG. 12 is an end elevation view, in section, of the ridge cap interlock strip illustrated in FIG. 11, taken along section lines A—A.

FIG. 13 is a side elevation view, in section, of the ridge cap interlock strip illustrated in FIG. 11, taken along section lines B—B.

FIG. 14 is a side elevation view, in section, of the roof shingle illustrated in FIG. 11, taken along section lines C—C.

DETAILED DESCRIPTION OF THE PREFERRED EMBODIMENT

Figure 8:
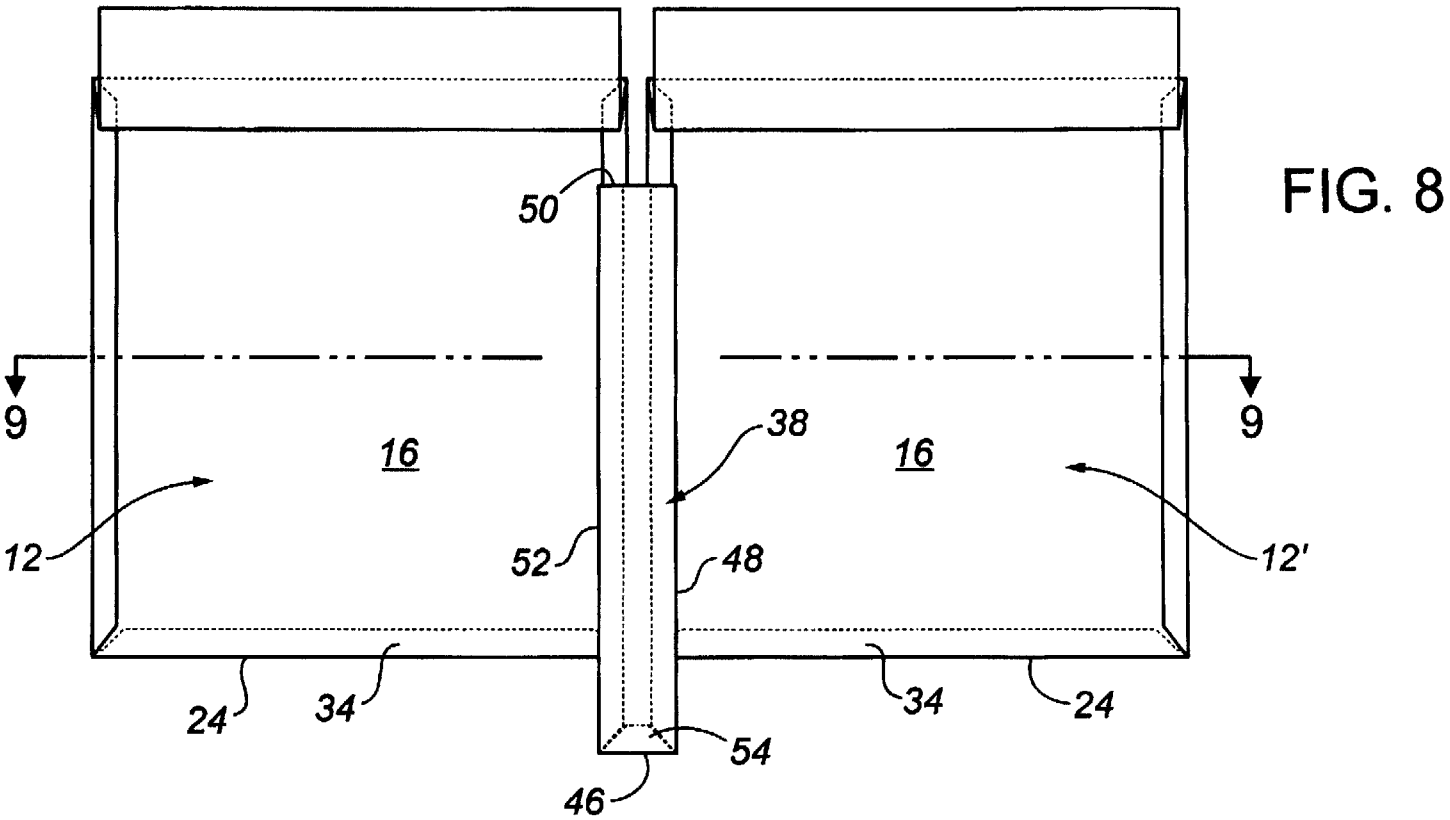
FIG. 8 is a top plan view of two roof shingles mated with an interlock strip in accordance with the teachings of the present invention.

The preferred embodiment, an interlocking roofing system generally identified by reference numeral 10, will now be described with reference to FIGS. 1 through 25, along with a preferred method of shingling a roof using such an interlocking roofing system.

Figure 21:
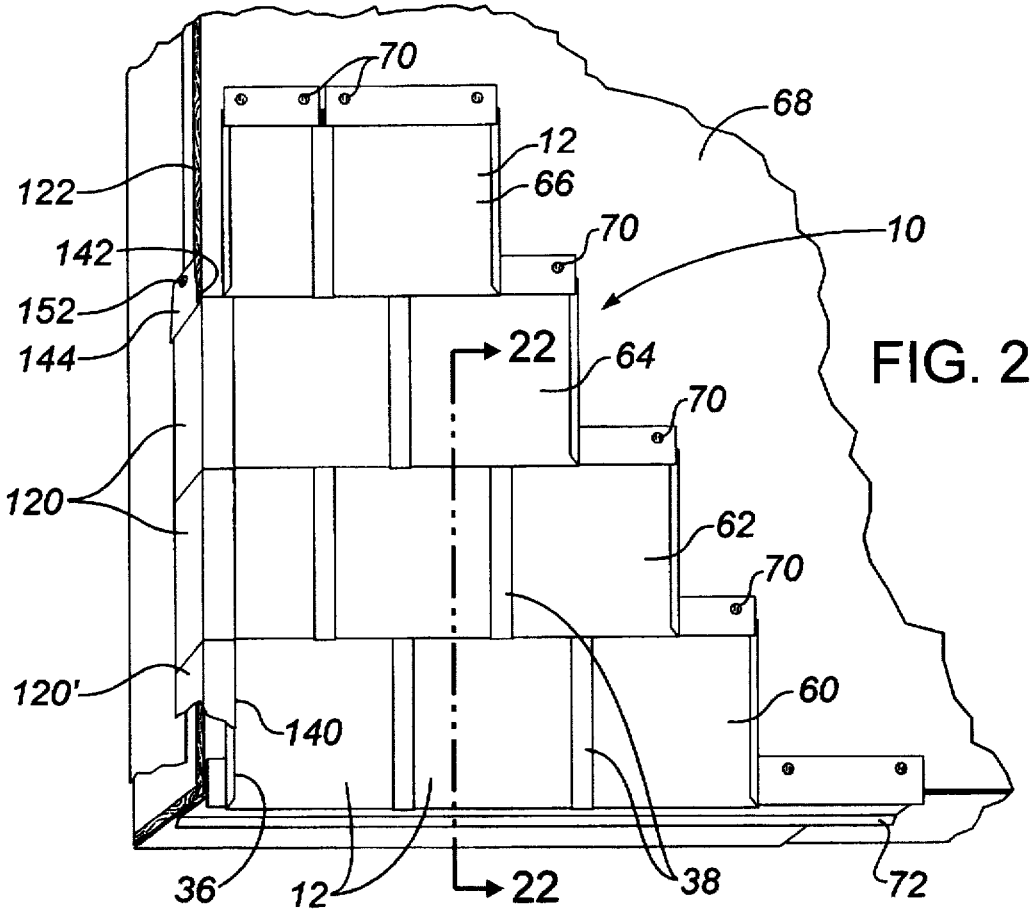
FIG. 21 is a first perspective view of a roof in the process of being completed with the interlocking roofing system in accordance with the teachings of the preferred method.

Referring to FIG. 21, a plurality of shingles 12 are provided. Referring to FIGS. 1 through 4, each shingles 12 includes a planar rectangular body 14 having a first face 16, a second face 18, a first side 20, a second side 22 adjacent first side 20, a third side 24 adjacent second side 22 and a fourth side 26 adjacent third side 24 and first side 20. Referring to FIG. 4, the first side 20 terminates in a double zigzig reentrant edge 28 having an end 30 which projects outwardly from body 14 adjacent and substantially parallel to first face 16. Referring to FIG. 2, second side 22 terminates in a single zigzig reentrant edge 32 which projects inwardly adjacent and substantially parallel to first face 16. Referring to FIG. 3, third side 24 terminates in a single zigzig reentrant edge 34 which projects inwardly adjacent and substantially parallel to second face 18. Fourth side 26 terminates in a single zigzig reentrant edge 36 which projects inwardly adjacent and substantially parallel to first face 16.

Referring to FIG. 21, a plurality of interlock strips 38 are provided. Referring to FIGS. 5 through 7, each of interlock strips 38 includes an elongate planar rectangular body 40 having a first face 42, a second face 44, a first side 46, a second side 48 adjacent first side 46, a third side 50 adjacent second side 48 and a fourth side 52 adjacent third side 50 and first side 46. Referring to FIG. 7, first side 46 terminates in a single zigzig reentrant edge 54 which projects inwardly adjacent and substantially parallel to second face 44. Referring to FIG. 6, second side 48 terminates in a single zigzig reentrant edge 56 which projects inwardly adjacent and substantially parallel to second face 44. Referring to FIG. 5, third side 50 terminates in an open edge. Referring to FIG. 6, fourth side 52 terminates in a single zigzig reentrant edge 58 which projects inwardly adjacent and substantially parallel to second face 44.

Figure 9:
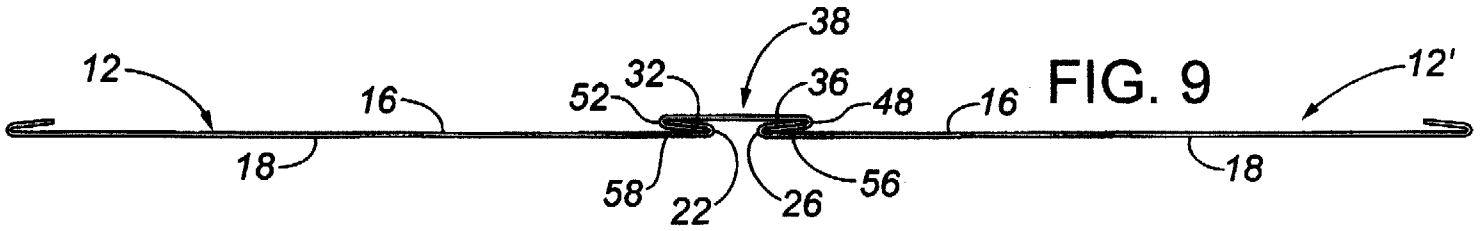
FIG. 9 is an end elevation view, in section, of the roof shingles and interlock strip illustrated in FIG. 8.
Figure 15:
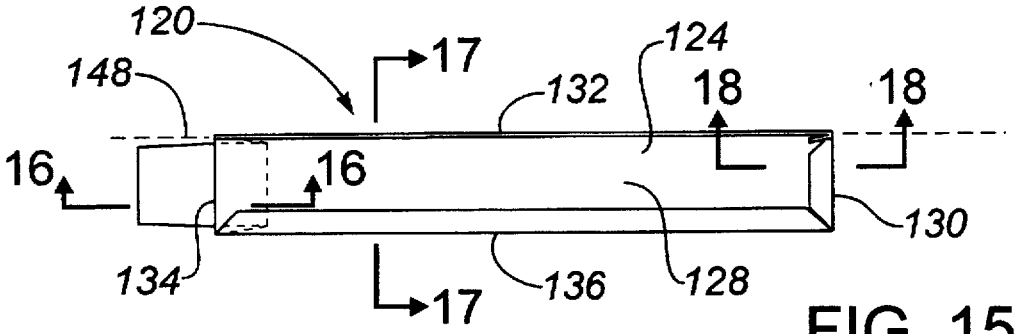
FIG. 15 is a top plan view of a roof edge interlock strip constructed in accordance with the teachings of the present invention.
Figure 22:
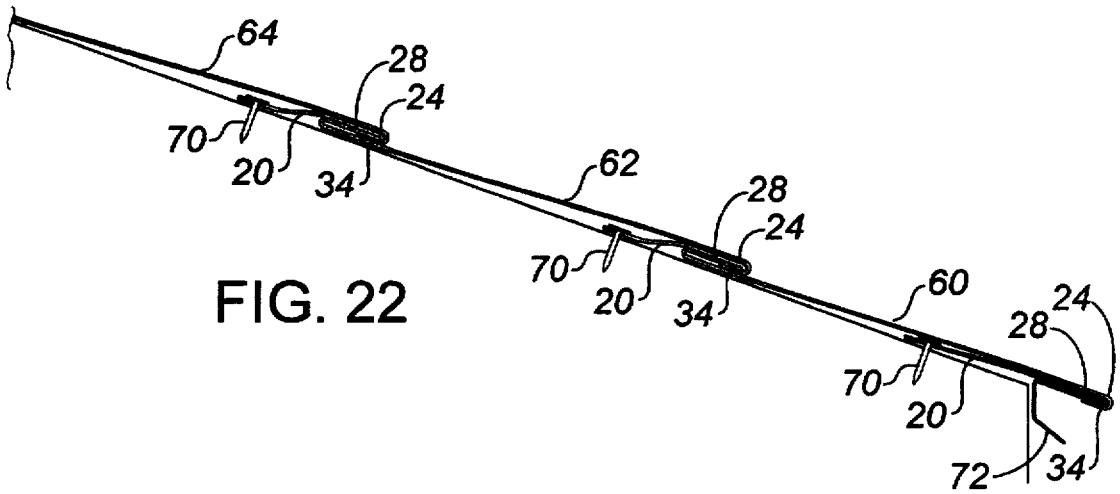
FIG. 22 is a side elevation view, in section, taken along section lines A—A of FIG. 21, showing the interlocking of rows of shingles.

The method of securing shingles 12 and interlock strips 38, in combination, in accordance with the teachings of the present method will now be described. Referring to FIG. 21, a plurality of shingles 12 are secured in rows 60, 62, 64, 66 along a roof 68 by placing shingles 12 in parallel spaced relation along roof 68. Shingles 12 will normally be spaced 1/16th of an inch apart to allow for movement and thermal expansion. Referring to FIGS. 8 and 9, second side 22 of one of plurality of shingles 12 is placed adjacent to fourth side 26 of an adjacent one of the plurality of shingles 12'. Referring to FIG. 21, shingles 12 are secured by driving fasteners 70 through end 30 of double zigzig reentrant edge 28 which projects outwardly from first side 20 body 14. Shingles 12 in each of rows 60, 62, 64, 66 are laterally staggered in relation to the next adjacent row. Referring to FIG. 22, shingles 12 from rows 60, 62, 64, 66 are interlocked by connecting single zigzig reentrant edge 34 on third side 24 adjacent second face 18 of one row of shingles 62 with double zigzig reentrant edge 28 on first side 20 adjacent first face 16 of next row of shingles 60. Referring to FIGS. 8 and 9, adjacent shingles 12 are interlocked with one of interlock strips 38. This is accomplished by sliding single zigzig reentrant edge 56 on second side 48 of interlock strip 38 under single zigzig reentrant edge 36 on fourth side 26 of shingle 12' and single zigzig reentrant edge 58 on fourth side 52 of interlock strip 38 under single zigzig reentrant edge 32 on second side 22 of shingle 12. Interlock strip 38 is slid along until single zigzig reentrant edge 54 on first side 46 of interlock strip 38 engages single zigzig reentrant edge 34 on third side 24 of each of shingles 12 and 12'. Along the eave of roof 68, a roof eave starter strip 72 is used, as illustrated in FIG. 10. Roof eave starter strip 72 provides an interlocking edge identical to double zigzig reentrant edge 28 of shingle 12.

Figure 19:
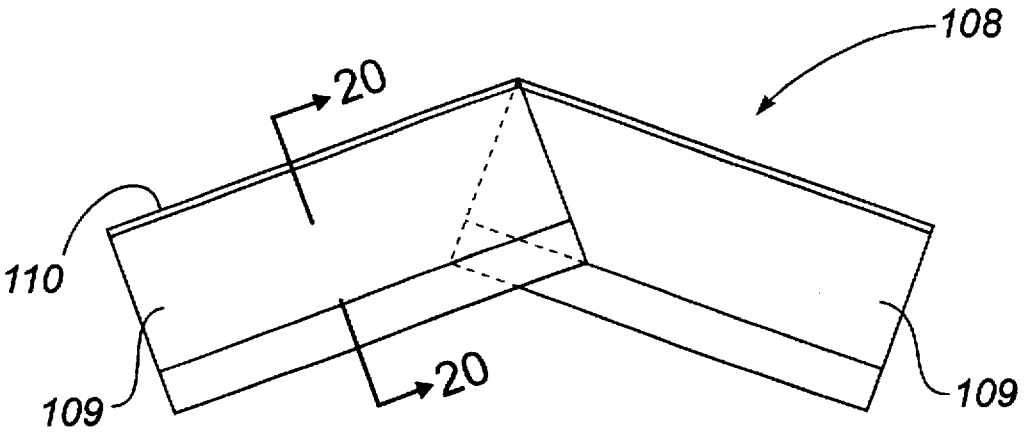
FIG. 19 is an end elevation view of a ridge cap end closure strip constructed accordance with the teachings of the present invention.
Figure 20:
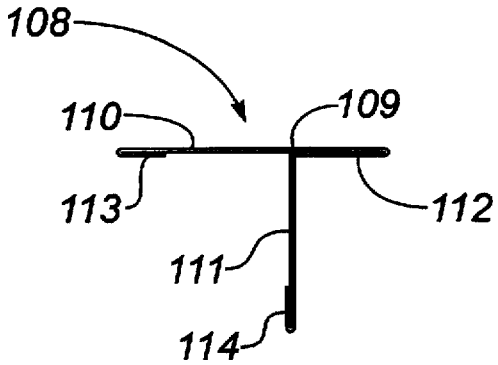
FIG. 20 is an end elevation view, in section, of the ridge cap end closure strip illustrated in FIG. 19, taken along section lines A—A.
Figure 24:
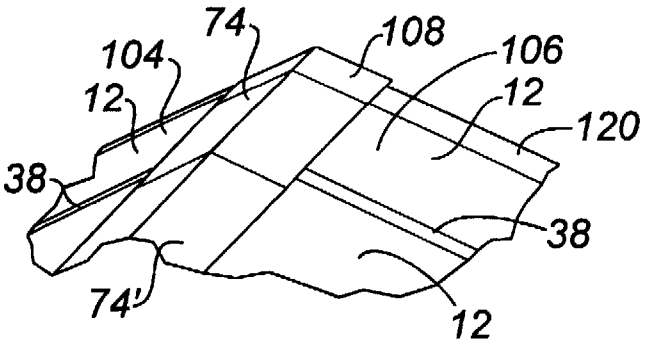
FIG. 24 is a third perspective view of a roof in the process of being completed with the interlocking roofing system in accordance with the teachings of the preferred method.
Figure 23:
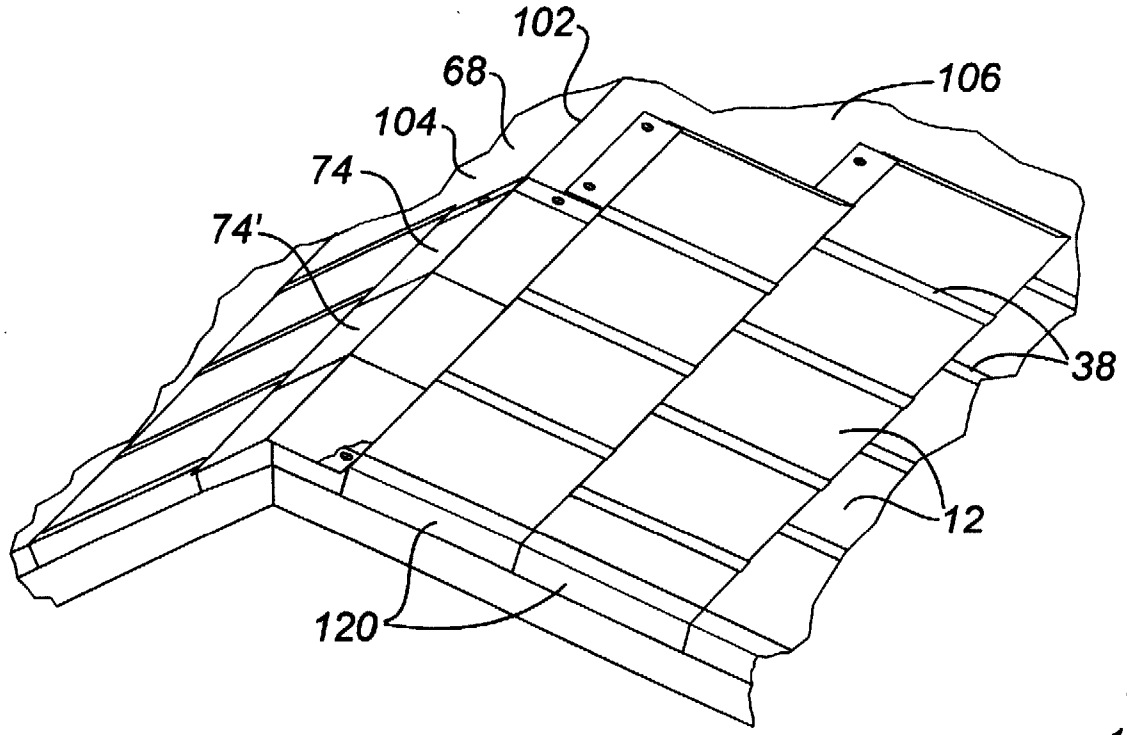
FIG. 23 is a second perspective view of a roof in the process of being completed with the interlocking roofing system in accordance with the teachings of the preferred method.
Figure 25:
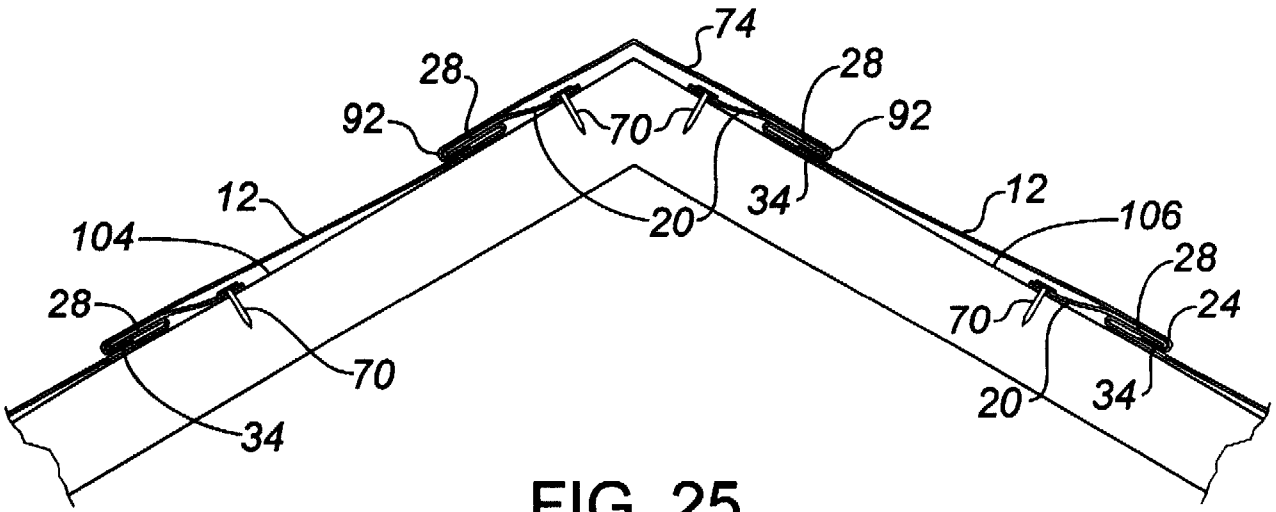
FIG. 25 is a side elevation view, in section, of FIG. 23, showing the ridge cap interlock.

Although the components described will cover the majority of the surface area of roof 68, it is preferred that some additional components be used when completing the roof. Referring to FIGS. 23 and 24, a plurality of ridge cap interlock strips 74 are used. Referring to FIGS. 11 through 14, each ridge cap interlock strip 74 includes an elongate planar rectangular body 76 having a first face 78, a second face 80, a first side 82, a second side 84 adjacent first side 82, a third side 86 adjacent second side 84 and a fourth side 88 adjacent third side 86 and first side 82. Referring to FIG. 13, first side 82 terminates in a single zigzig reentrant edge 90 which projects inwardly adjacent and substantially parallel to second face 80. Referring to FIG. 12, second side 84 terminates in a single zigzig reentrant edge 92 which projects inwardly adjacent and substantially parallel to second face 80. Referring to FIG. 14, third side 86 terminates in a double zigzig reentrant edge 94 having an end 96 which projects outwardly from body 76 adjacent and substantially parallel to first face 78. Referring to FIG. 12, fourth side 88 terminates in a single zigzig reentrant edge 98 which projects inwardly adjacent and substantially parallel to second face 80. Referring to FIG. 11, a bend line 100 extends along elongate body 76 from first side 82 to third side 86 substantially equidistant between second side 84 and fourth side 88. Referring to FIG. 12, bend line 100 facilitates the bending of elongate body 76 to match the slope of the roof. Referring to FIGS. 23 and 25, ridge cap interlock strips 74 are used to cover a ridge 102 of roof 68. This is accomplished by sliding single zigzig reentrant edge 92 on second side 84 of ridge cap interlock strip 74 under double zigzig reentrant edge 28 on first side 20 of shingles 12 on a first slope 104 of roof 68 and sliding single zigzig reentrant edge 98 on fourth side 88 of ridge cap interlock strip 74 under double zigzig reentrant edge 28 on first side 20 of shingles 12 on a second slope 106 of roof 68. Each of ridge cap interlock strips 74 is slid along ridge 102 of roof 68 until single zigzig reentrant edge 90 on first side 82 of ridge cap interlock strip 74 engages double zigzig reentrant edge 94 on third side 86 of a preceding ridge cap interlock strip 74'. Referring to FIG. 24, the last ridge cap interlock strip 74 on ridge 102 of roof 68 is closed using a ridge cap end closure strip 108. Referring to FIG. 19, ridge cap end closure strip 108 is bent into two sections 109. Referring to FIG. 20, ridge cap end closure strip 108 has a first or exterior side 110 and a second or interior side 111. Each section 109 has a clamping portion 112 and two single zigzig reentrant edge 113 and 114 directed inwardly on second side 111. Clamping portion 112 clamps onto projecting end 96 of ridge cap interlock strip 74. Zigzig reentrant edge 113 engages double zigzig reentrant edge 94 on third side 86 of ridge cap interlock strip 74. Zigzig reentrant edge 114 engages roof edge interlock strip 120, which is hereinafter further described. Ridge cap end closure strip is shown in position in FIG. 24.

Figure 16:
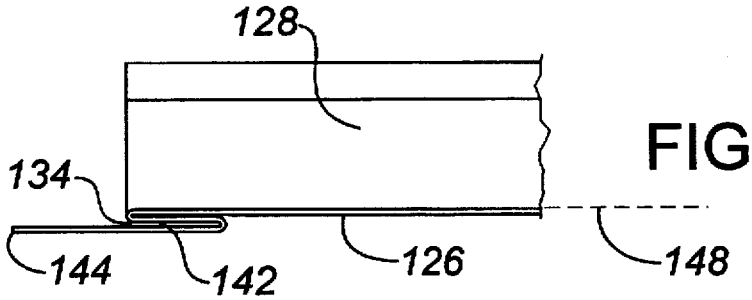
FIG. 16 is an end elevation view, in section, of the roof edge interlock strip illustrated in FIG. 15, taken along section lines A—A.
Figure 17:
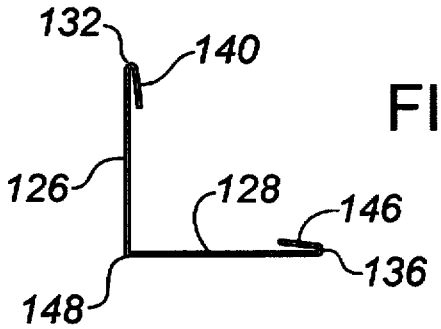
FIG. 17 is a side elevation view, in section, of the roof edge interlock strip illustrated in FIG. 15, taken along section lines B—B.
Figure 18:
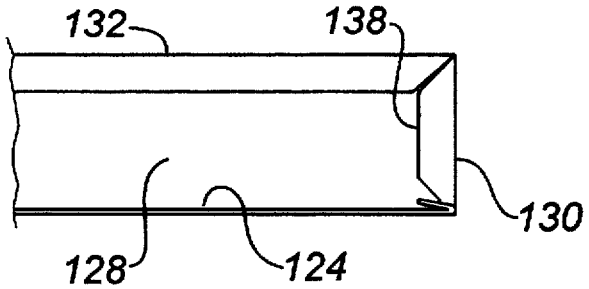
FIG. 18 is a side elevation view, in section, of the roof edge interlock strip illustrated in FIG. 15, taken along section lines C—C.

Referring to FIGS. 21 and 22, a plurality of roof edge interlock strips 120 are used to complete edge 122 of roof 68. Referring to FIGS. 15 through 18, each roof edge interlock strip 120 includes an elongate body 124 which is generally "L" shaped in cross-section. Elongate body 124 has a first face 126, a second face 128, a first side 130, a second side 132 adjacent first side 130, a third side 134 adjacent second side 132 and a fourth side 136 adjacent third side 134 and first side 130. Referring to FIG. 18, first side 130 terminates in a single zigzig reentrant edge 138 which projects inwardly adjacent and substantially parallel to second face 128. Referring to FIG. 17, second side 132 terminates in a single zigzig reentrant edge 140 which projects inwardly adjacent and substantially parallel to first face 126. Referring to FIG. 16, third side 134 terminates in a double zigzig reentrant edge 142 having an end 144 which projects outwardly from body 124 adjacent and substantially parallel to first face 126. Referring to FIG. 17, fourth side 136 terminates in a single zigzig reentrant edge 146 which projects inwardly adjacent and substantially parallel to second face 128. Referring to FIG. 17, elongate body 124 is bent at substantially 90 degrees along a bend line 148 which extends from first side 130 to third side 134 substantially equidistant between second side 132 and fourth side 136. Referring to FIG. 21, roof edge interlock strips 120 cover edge 122 of roof 68. This is accomplished by engaging single zigzig reentrant edge 140 or 146 on either second side 132 or fourth side 136 of roof edge interlock strip 120 with shingles with shingles 12. Whether the second side 132 or fourth side 136 is required is dependent upon which edge of the roof is being completed. Single zigzig reentrant edge 140 on second side 132 of roof edge interlock strip 120 engages single zigzig reentrant edge 36 on fourth side 26 of shingles 12 positioned immediately adjacent edge 122 of roof 68. The engagement is between single zigzig reentrant edge 146 on fourth side 136 of roof edge interlock strip 120 and single zigzig reentrant edge 32 on second side 22 shingles 12 positioned immediately adjacent edge 122 of roof 68. Referring to FIG. 21 whichever side of roof edge interlock strip that is not engaged rests against adjacent roof edge 122. Referring to FIG. 21, single zigzig reentrant edge 138 on first side 130 of roof edge interlock strip 120 engages roof eave starter strip 72. Each succeeding one of roof edge interlock strips 120 is slid along edge 122 of roof 68 until single zigzig reentrant edge 138 on first side 130 of roof edge interlock strip 120 engages double zigzig reentrant edge 142 on third side 134 of a preceding roof edge interlock strip 120'. Nails 152 are then driven through projecting end 144 of double zigzig reentrant edge 142 into edge 122 of roof 68 to secure roof edge interlock strip 120' in position.

The components of the interlocking roofing system described can be made from any suitable material. Metal or a rigid and durable vinyl are preferred.

It will be apparent to one skilled in that art that interlock strip provides a means for allowing for irregularities in a roof. Gaps of up to ½ of an inch can be accommodated without adversely effecting the engagement between the interlock strip and the shingles. It will also be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A shingle, comprising:

a planar rectangular body having a first face, a second face, a first side, a second side, a third side and fourth side;

the first side including a double zigzag reentrant edge which projects outwardly from the body adjacent and substantially parallel to the first face;

each of the second side and the fourth side including a single zigzag reentrant edge which projects inwardly adjacent and substantially parallel to the first face; and the third side including a single zigzag reentrant edge which projects inwardly adjacent and substantially parallel to the second face.

2. An interlocking roofing system, comprising in combination:

a plurality of shingles, each of the shingles including; a planar rectangular body having a first face, a second face, a first side, a second side adjacent the first side, a third side adjacent the second side and a fourth side adjacent the third and first sides; the first side terminating in a double zigzag reentrant edge having an end which projects outwardly from the body adjacent and substantially parallel to the first face, the second side terminating in a single zigzag reentrant edge which projects inwardly adjacent and substantially parallel to the first face, the third side terminating in a single zigzag reentrant edge which projects inwardly adjacent and substantially parallel to the second face, the fourth side terminating in a single zigzag reentrant edge which projects inwardly adjacent and substantially parallel to the first face, such that horizontal rows of shingles are interlocked by hooking the single zigzag reentrant edge on the third side adjacent the second face of one horizontal row of shingles in interlocking engagement with the double zigzag reentrant edge on the first side adjacent the first face of another horizontal row of shingles;

a plurality of interlock strips, each of the interlock strips including; an elongate planar rectangular body having a first face, a second face, a first side, a second side adjacent the first side, a third side adjacent the second side and a fourth side adjacent the third and first sides; the first side terminating in a single zigzag reentrant edge which projects inwardly adjacent and substantially parallel to the second face, the second side terminating in a single zigzag reentrant edge which projects inwardly adjacent and substantially parallel to the second face, the third side terminating in an open edge; the fourth side terminating in a single zigzag reentrant edge which projects inwardly adjacent and substantially parallel to the second face, such that shingles in parallel spaced relation with the fourth side of a first shingle adjacent the second side of a second shingle are interlocked by sliding the single zigzag reentrant edge on the second side of the interlock strip under the single zigzag reentrant edge on the fourth side of the first shingle and the single zigzag reentrant edge on the fourth side of the interlock strip under the single zigzag reentrant edge on the second side of the second shingle, the interlock strip being slid along until the single zigzag reentrant edge on the first side of the interlock strip engages the third side of the shingles.

3. The interlocking roofing system as defined in claim 2, wherein the combination includes a plurality of ridge cap interlock strips for interlocking with the first side of the shingles in an uppermost one of the horizontal rows of shingles, each ridge cap interlock strip including; an elongate planar rectangular body having a first face, a second face, a first side, a second side adjacent the first side, a third side adjacent the second side and a fourth side adjacent the third and first sides; the first side terminating in a single zigzag reentrant edge which projects inwardly adjacent and substantially parallel to the second face, the second side terminating in a single zigzag reentrant edge which projects inwardly adjacent and substantially parallel to the second face, the third side terminating in a double zigzag reentrant edge having an end which projects outwardly from the body adjacent and substantially parallel to the first face, the fourth side terminating in a single zigzag reentrant edge which projects inwardly adjacent and substantially parallel to the second face, a bend line extending along the elongate body from the first side to the third side substantially equidistant between the second side and the fourth side.

4. The interlocking roofing system as defined in claim 2, wherein the combination includes a plurality of roof edge interlock strips for interlocking with one of the second side and the fourth side of the shingles along an edge of a roof, each roof edge interlock strip including; an elongate body which is "L" shaped in cross-section, the elongate body having a first face, a second face, a first side, a second side adjacent the first side, a third side adjacent the second side and a fourth side adjacent the third and first sides; the first side terminating in a single zigzag reentrant edge which projects inwardly adjacent and substantially parallel to the second face, the second side terminating in a single zigzag reentrant edge which projects inwardly adjacent and substantially parallel to the second face, the third side terminating in a double zigzag reentrant edge having an end which projects outwardly from the body adjacent and substantially parallel to the first face, the fourth side terminating in a single zigzag reentrant edge which projects inwardly adjacent and substantially parallel to the second face, a bend line extending along the elongate body from the first side to the third side substantially equidistant between the second side and the fourth side.

5. A method of shingling a roof, comprising the steps of:

firstly providing a plurality of shingles, each the shingles including; a planar rectangular body having a first face, a second face, a first side, a second side adjacent the first side, a third side adjacent the second side and a fourth side adjacent the third and first sides; the first side terminating in a double zigzag reentrant edge having an end which projects outwardly from the body adjacent and substantially parallel to the first face, the second side terminating in a single zigzag reentrant edge which projects inwardly adjacent and substantially parallel to the first face, the third side terminating in a single zigzag reentrant edge which projects inwardly adjacent and substantially parallel to the second face, the fourth side terminating in a single zigzag reentrant edge which projects inwardly adjacent and substantially parallel to the first face;

secondly, providing a plurality of interlock strips, each of the interlock strips including: an elongate planar rectangular body having a first face, a second face, a first side, a second side adjacent the first side, a third side adjacent the second side and a fourth side adjacent the third and first sides; the first side terminating in a single zigzag reentrant edge which projects inwardly adjacent and substantially parallel to the second face, the second side terminating in a single zigzag reentrant edge which projects inwardly adjacent and substantially parallel to the second face, the third side terminating in an open edge, the fourth side terminating in a single zigzag reentrant edge which projects inwardly adjacent and substantially parallel to the second face;

thirdly, securing a plurality of the shingles in rows along a roof by placing the shingles in parallel spaced relation along the roof with the second side of one of the plurality of shingles placed adjacent to the fourth side of an adjacent one of the plurality of shingles, the shingles being secured by driving fasteners through the end of the double zigzag reentrant edge which projects outwardly from the bodies, the shingles in each of the rows being laterally staggered in relation to a next adjacent row, the rows of shingles being interlocked by connecting the single zigzag reentrant edge on the third side adjacent the second face of one row of shingles with the double zigzag reentrant edge on the first side adjacent the first face of the next adjacent row of shingles; and fourthly, interlocking adjacent shingles with one of the plurality of interlock strips by sliding the single zigzag reentrant edge on the second side of the interlock strip under the single zigzag reentrant edge on fourth side of the adjacent one shingle and the single zigzag reentrant edge on the fourth side of the interlock strip under the single zigzag reentrant edge on the second side of the one shingle, each of the interlock strips being slid along until the single zigzag reentrant edge on the first side of the interlock strip engages the third side of the shingles.

6. The method as defined in claim 5, including the further steps of:

providing a plurality of ridge cap interlock strips, each ridge cap interlock strip including; an elongate planar rectangular body having a first face, a second face, a first side, a second side adjacent the first side, a third side adjacent the second side and a fourth side adjacent the third and first sides; the first side terminating in a single zigzag reentrant edge which projects inwardly adjacent and substantially parallel to the second face, the second side terminating in a single zigzag reentrant edge which projects inwardly adjacent and substantially parallel to the second face, the third side terminating in a double zigzag reentrant edge having an end which projects outwardly from the body adjacent and substantially parallel to the first face, the fourth side terminating in a single zigzag reentrant edge which projects inwardly adjacent and substantially parallel to the second face, a bend line extending along the elongate body from the first side to the third side substantially equidistant between the second side and the fourth side;

securing the plurality of ridge cap interlock strips to cover a ridge of a roof by sliding the single zigzag reentrant edge on the second side of the ridge cap interlock strip under the double zigzag reentrant edge on the first side of shingles on a first slope of the roof, sliding the single zigzag reentrant edge on the fourth side of the ridge cap interlock strip under the double zigzag reentrant edge on the first side of shingles on a second slope of the roof, each succeeding one of the ridge cap interlock strips being slid along the ridge of the roof until the single zigzag reentrant edge on the first side of the ridge cap interlock strip engages the double zigzag reentrant edge on the third side of a preceding ridge cap interlock strip.

7. The method as defined in claim 5, further including the steps of:

providing a plurality of roof edge interlock strips, each roof edge interlock strip including; an elongate body which is "L" shaped in cross-section, the elongate body having a first face, a second face, a first side, a second side adjacent the first side, a third side adjacent the second side and a fourth side adjacent the third and first sides; the first side terminating in a single zigzag reentrant edge which projects inwardly adjacent and substantially parallel to the second face, the second side terminating in a single zigzag reentrant edge which projects inwardly adjacent and substantially parallel to the second face, the third side terminating in a double zigzag reentrant edge having an end which projects outwardly from the body adjacent and substantially parallel to the first face, the fourth side terminating in a single zigzag reentrant edge which projects inwardly adjacent and substantially parallel to the second face, a bend line extending along the elongate body from the first side to the third side substantially equidistant between the second side and the fourth side;

securing the plurality of roof edge interlock strips to cover an edge of a roof by sliding the single zigzag reentrant edge on one of the second side and the fourth side of the roof edge interlock strip under the single zigzag reentrant edge on one of the second side and the fourth side of shingles positioned immediately adjacent the edge of the roof with the other of the second side and the fourth side of the roof edge interlock strips resting against gable facia adjacent the roof edge, sliding a first roof edge interlock strip along until the single zigzag reentrant edge on the first side of the roof edge interlock strip engages the third side of one of the shingles, each succeeding one of the roof edge interlock strips being slid along the edge of the roof until the single zigzag reentrant edge on the first side of the roof edge interlock strip engages the double zigzag reentrant edge on the third side of a preceding roof edge interlock strip.

* * * * *